US006250936B1

(12) United States Patent
Armistead et al.

(10) Patent No.: US 6,250,936 B1
(45) Date of Patent: Jun. 26, 2001

(54) SINGLE-PORT CONNECTION AND CIRCUITRY ACCEPTING BOTH BALANCED AND UNBALANCED DATA SIGNALS

(75) Inventors: R. Ashby Armistead, Los Altos; David W. Metcalf, Santa Cruz; Danyang Raymond Zheng, Fremont, all of CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/129,671

(22) Filed: Aug. 5, 1998

(51) Int. Cl.[7] ..... H01R 13/652

(52) U.S. Cl. ..... 439/98; 439/108; 439/610; 333/24 R

(58) Field of Search ..... 333/24 R, 260, 333/124, 243, 245; 439/92, 98, 99, 607, 610, 912, 578, 580

(56) References Cited

U.S. PATENT DOCUMENTS 5,554,038 * 9/1996 Morlion et al. ..... 439/108

5,681,172 * 10/1997 Moldenhauer ..... 439/95

* cited by examiner

*Primary Examiner*—Benny Lee
*Assistant Examiner*—Stephen E. Jones
(74) *Attorney, Agent, or Firm*—Marger Johnson & McCollom P.C.

(57) ABSTRACT

A circuit and method for connecting data lines to a digital communication system are disclosed. The circuit allows either a balanced data line or an unbalanced data line to be connected to a single input port with no internal reconfiguration of the system. Connection to a balanced data line isolation transformer is provided at the port. A separate connection to ground is provided at the same port. A user connects the system to a balanced data line using a jack wired for connecting the balanced data line pair across the isolation transformer. A user connects the system to an unbalanced data line using a similar jack; however, the jack in this case is wired to short one transformer connection to the ground connection provided at the port, thereby unbalancing the transformer. In one embodiment, this second jack is part of a patch cable which accepts a coaxial connector on one end, appropriately wired to the shorted jack on the second end.

20 Claims, 6 Drawing Sheets

SINGLE-PORT CONNECTION AND CIRCUITRY ACCEPTING BOTH BALANCED AND UNBALANCED DATA SIGNALS

FIELD OF THE INVENTION

This invention pertains generally to digital communications over cabled networks, and more particularly to structures and methods for connecting communication systems to the lines of a communications network.

BACKGROUND OF THE INVENTION

Telecommunications employs the transmittal of data over a distance. A given transmission may travel over a common electrical wire, a fiber optic cable, a terrestrial microwave link, or even a satellite link; indeed, most distant transmissions use more than one of these media as they travel from sender to receiver. However, most equipment at the receiving or transmitting end of a signal connects to an electrical wire, usually because of simplicity, cost, and the lower bandwidth requirements of end equipment.

Two types of wires are most commonly used for connecting data lines to end equipment. The first is the twisted-pair conductor (see FIG. 1), which consists of two thin, insulated electrical conductors 20, 22 twisted together in a helical fashion. The second is the coaxial conductor (see FIG. 2), which consists of a single insulated center conductor 24 surrounded by a braided conducting sheath 26 and an outer, insulating protective covering 28. The twisted-pair conductor enjoys a price advantage over the coaxial conductor. The twisted-pair conductor also occupies less space, such that several twisted pairs can be bundled in a cable roughly the size of one coaxial conductor. The coaxial conductor also has advantages; for example, it is less fragile and better suited for high-bandwidth communications.

Twisted pairs generally operate in a differential mode, while coaxial conductors operate in a single-ended mode. In differential mode, a positive signal change on one wire is coupled with an equally negative signal change on its pair. This differential signal reduces radiated noise from the twisted pair. In contrast, single-ended transmission occurs over a single wire between two devices sharing a common ground connection. With a coaxial cable, the center conductor provides a signal path and the braided sheath is generally tied to the equipment chassis ground. The differential mode of transmission is commonly termed "balanced" because both wires act equally in sending a signal, while the single-ended mode is known as "unbalanced" because a single wire carries the signal.

Equipment suppliers have historically offered either a balanced or an unbalanced connection on a single system. Some suppliers have also offered systems that have dual connection ports, with the customer being responsible for removing a cover from a unit and installing one or more internal jumpers to complete the system configuration.

SUMMARY OF THE INVENTION

With the continued trend towards smaller and more powerful integrated circuits, equipment producers have been able to offer relatively small physical products that can handle a large number of data signal inputs and outputs. These systems may have the added flexibility of being able to interpret or produce data in several formats. With such systems, the panel space available for input and output connections can become a limiting factor in both the size and the flexibility of the product.

It has now been recognized that a need exists for a single system that, while conserving panel space, allows a customer to connect to multiple twisted-pair, multiple coaxial, or even a mix of twisted-pair and coaxial data inputs and outputs as the customer desires. It has also now been recognized that a configurable system not only should be flexible, but preferably should be relatively foolproof; i.e., the customer should not be expected to disassemble a system and properly install 24 jumpers in order to connect 24 inputs and outputs to the system.

In response to this need, the present invention allows connection of either a balanced or unbalanced data connection to a system through a single data port and a single isolation transformer. The system typically supplies, at the port, two transformer contacts connected across a balanced isolation transformer and a third contact connected to ground. A balanced signal is connected to the system using a jack that mechanically engages with the port such that the two balanced signal wires are connected to the two transformer contacts. An unbalanced signal is connected to the system using a similar jack engaged with the same port; however, this jack is wired such that the single unbalanced conductor is connected to one transformer contact, and the conductor shield is connected to both the other transformer contact and the ground contact. This second jack configuration automatically unbalances the system's isolation transformer when the jack is inserted into the data port.

To make the present invention simple for the user, the unbalanced jack is preferably part of a "patch cable" that may be supplied with the system. The patch cable provides the necessary connections to unbalance a system's transformer, while preferably providing a second end with a connector traditionally used with unbalanced cables, such as a BNC connector. This allows a customer little leeway for misconnection—the customer simply connects the jack into the system port, and connects the other end of the patch cable directly to the data line as a traditional unbalanced cable connection.

A related problem solved by the invention is the problem of providing signal and system testing and monitoring for a multiple-data-line system, as test ports also consume panel space. This problem compounds when the customer may connect either balanced or unbalanced inputs to a system without internal system reconfiguration. The present invention thus also provides for a single-port test connection that allows signal monitoring whether the connected signal line is balanced or unbalanced. This invention further provides for the inclusion of an electronic test port controller that advantageously allows a user to electronically reroute any one of the system data inputs and outputs to a common port for monitoring or testing. This design saves panel space, reduces the possibility for operator error and equipment damage, and allows switching of a monitoring function between data lines without disturbing ongoing data communication.

The foregoing and other objects, features and advantages of the invention will become more readily apparent from the following detailed description of a preferred embodiment of the invention which proceeds with reference to the accompanying drawings.

BRIEF DESCRIPTION OF THE DRAWING

The invention may be best understood by reading the disclosure with reference to the following figures.

DETAILED DESCRIPTION OF THE PREFERRED EMBODIMENTS

The present invention generally applies to circuits for processing and communicating digital signals over a wire, whether these circuits send, receive, or both send and receive digital signals over such a wire. Examples of such circuits include access concentrators, switches, bridges, routers, modem boards, private branch exchange (PBX) equipment, and central site telephone equipment. However, this description will not detail the well-understood operation of such equipment. Instead, the following description focuses on line and test connections to such equipment.

The following terms have the following meanings for purposes of this disclosure. A digital data signal is any signal that conveys digital information; such a signal may be baseband or broadband, and is not limited to any specific physical signaling scheme. A processor constructs, modifies, translates, disassembles, and/or interprets digital data signals. A digital communication system comprises a processor and is connectable to one or more digital data signals. A wire includes an electrical conductor pair; some examples of a wire are a coaxial cable, a twisted pair, a cable containing several twisted pairs, and a single conductor connecting two devices sharing a common groundplane. An electrical connection requires an electrically conductive path, although such a path may include inductive coupling such as a transformer, unless the connection requires direct current, such as a DC power supply or ground connection.

In a preferred embodiment, a digital communication system comprises an external data port. This data port may be chosen from a variety of shapes and sizes, e.g., round, rectangular, circular, trapezoidal. It may comprise an electrically conductive shell. It may employ one of a variety of mechanisms for completing electrical contacts, e.g., pins, sockets, or spring-loaded contacts. One preferable port configuration accepts an eight-contact modular "registered" jack, often referred to as an RJ45 jack.

Figure 4:
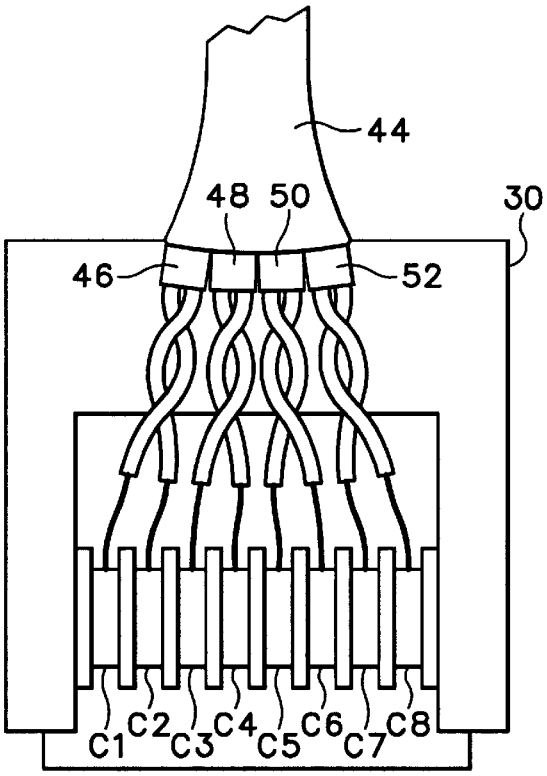
FIG.4 (PRIOR ART)
FIG. 4, which depicts a prior art usage of an RJ45 connector.

RJ45 jacks are commonly used for connecting computers to local area networks. For example, FIG. 4 shows an RJ45 jack 30, with eight contacts C1–C8. This jack is connected to a cable 44 carrying four twisted pair, 46, 48, 50, and 52. These twisted pair are electrically connected to contacts C1–C8 within jack 30.

Figure 5:
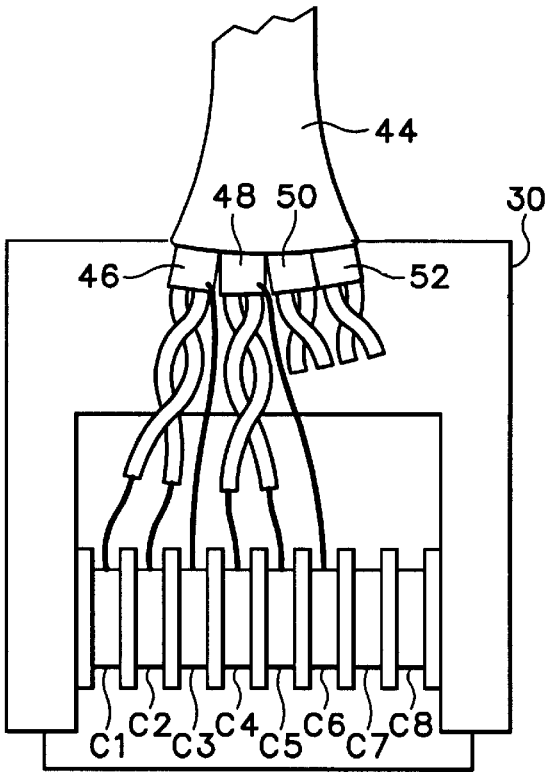
FIG. 5, which illustrates wiring of an RJ45 connector for use with a balanced signal in an embodiment of the present invention.

Specific jack and port wiring configurations for use with the present invention will now be described. First, FIG. 5 illustrates an RJ45 jack 30 connected to a cable 44 for use with an embodiment of the present invention. Twisted pairs 46 and 48 respectively carry balanced receive and transmit signals, as is typical for a two-way balanced communication link. The tip and ring lines of pair 46 connect respectively to contacts C1 and C2. The tip and ring lines of pair 48 connect likewise to contacts C4 and C5. Optionally and as shown, if pairs 46 and 48 are shielded, their shields may be respectively connected to contacts C3 and C6. Note also that twisted pairs 50 and 52, if they exist as part of cable 44, are left unconnected in this embodiment.

Figure 1:
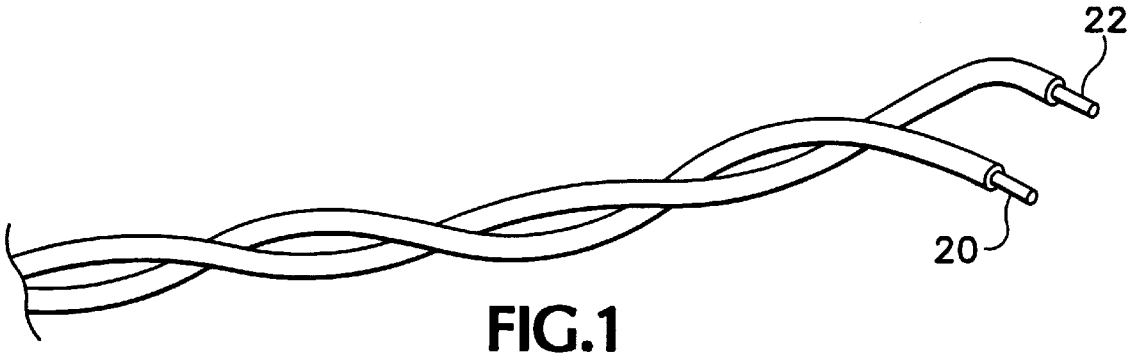
FIG.1 (PRIOR ART)
FIGS. 1 and 2, which respectively illustrate prior art of a twisted pair conductor and a coaxial conductor.
Figure 2:
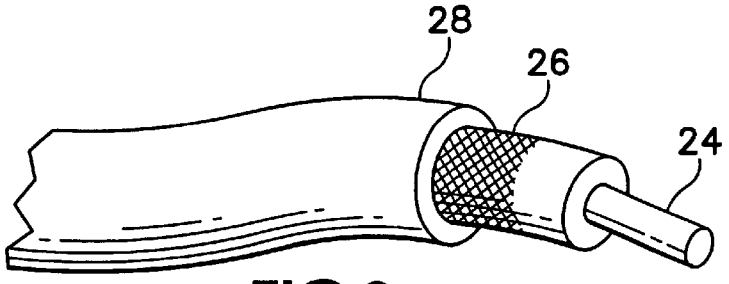
FIG.2 (PRIOR ART)
Figure 3:
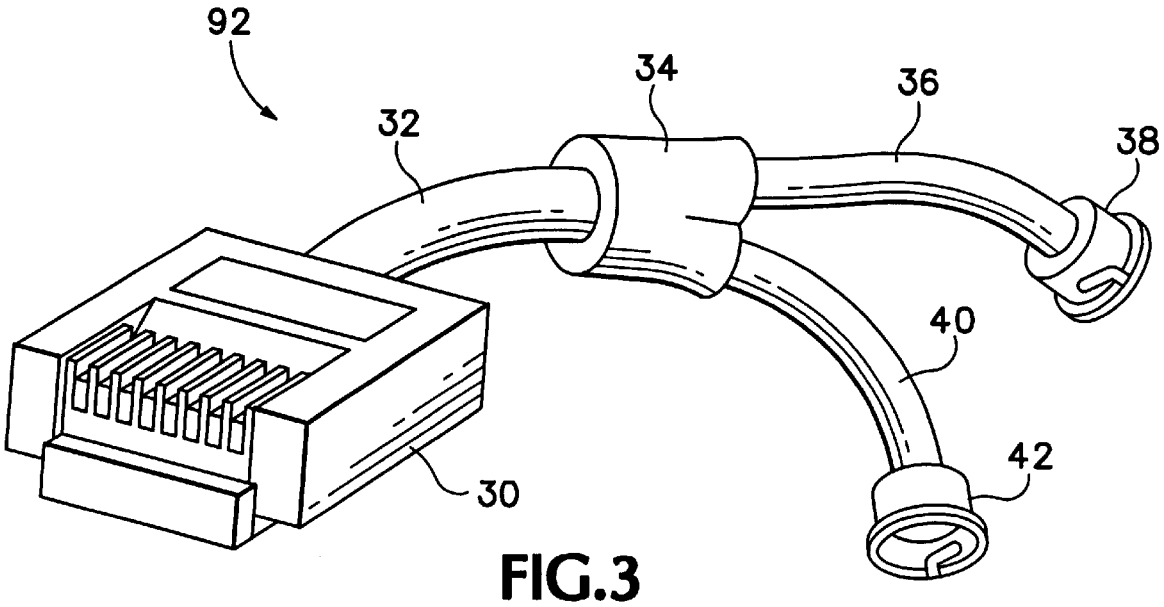
FIG. 3, which illustrates a coaxial to RJ45 patch cable according to an embodiment of the present invention.
Figure 6:
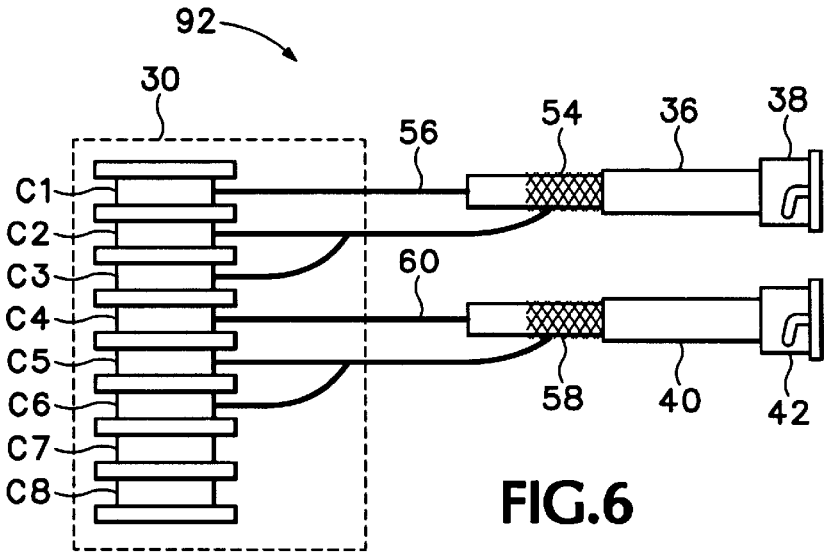
FIG. 6, which shows a particular dual-coaxial to RJ45 pin connection scheme for use with unbalanced signals in an embodiment of the present invention.

An RJ45 jack also may be used to connect a receive/send pair of unbalanced signal wires (e.g., two coaxial cables) to a system according to an embodiment of the present invention. In a preferred embodiment illustrated in FIGS. 3 and 6, a jack 30 is wired as part of a patch cable 92. At one end of cable 92, RJ45 jack 30 is physically connected to jack cable 32, typically a four-twisted-pair cable section. An adapter section 34 connects to both jack cable 32, receive coax cable 36, and transmit coax cable 40. Coax cables 36 and 40 are preferably terminated with coaxial connectors 38 and 42, for instance BNC female connectors as shown.

Within patch cable 92, several electrical connections are required. First, conductor 56 of receive coax 36 electrically connects to contact C1 of jack 30, the "receive tip" connection in the balanced connection of FIG. 5. Second, shield 54 of receive coax 36 electrically connects to contact C2 of jack 30, the "receive ring" connection in the balanced connection of FIG. 5. Third, shield 54 also connects to contact C3. Transmit coax 40 connects to contacts C4–C6 in like fashion.

Figure 7:
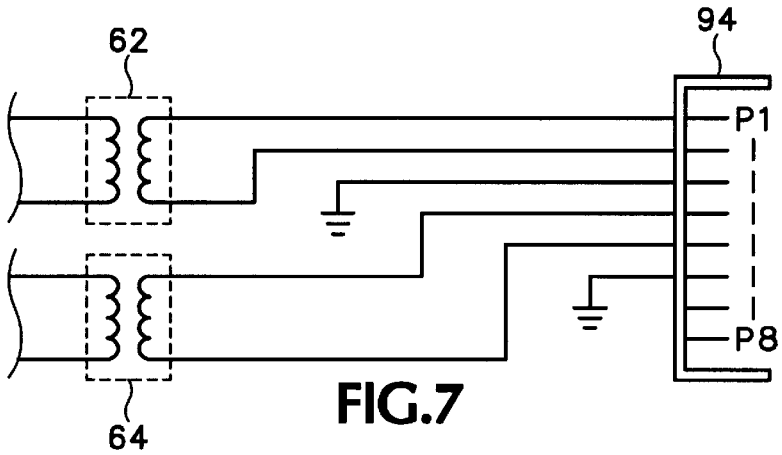
FIG. 7, which illustrates pinout connections for an RJ45 receptacle on a system embodiment according to the present invention.

FIG. 7 shows an external data port 94 and its electrical connections within a typical system. Port contacts P1–P8 are designed to make electrical contact with jack contacts C–C8 when a jack 30 is mechanically engaged with port 94. Port contacts P1 and P2 connect across one side of isolation transformer 62. Port contacts P3 and P4 connect across one side of isolation transformer 64. Port contacts P3 and P6 are grounded, and port contacts P7 and P8 are unused in this embodiment.

With the jack and port connections of the foregoing description, the ease of configuration of a system utilizing such a data connection scheme can be appreciated. Transformers 62 and 64 both present balanced connections at port 94, such that a jack wired according to FIG. 5 allows connection of a balanced receive/send signal pair to a system. But the system can be quickly reconfigured to accept unbalanced connections merely by connecting patch cable 92 to port 94, automatically unbalancing transformers 62 and 64. Unbalanced signals then may connect directly to the system through coaxial connectors 38 and 42 of patch cable 92.

Figure 8:
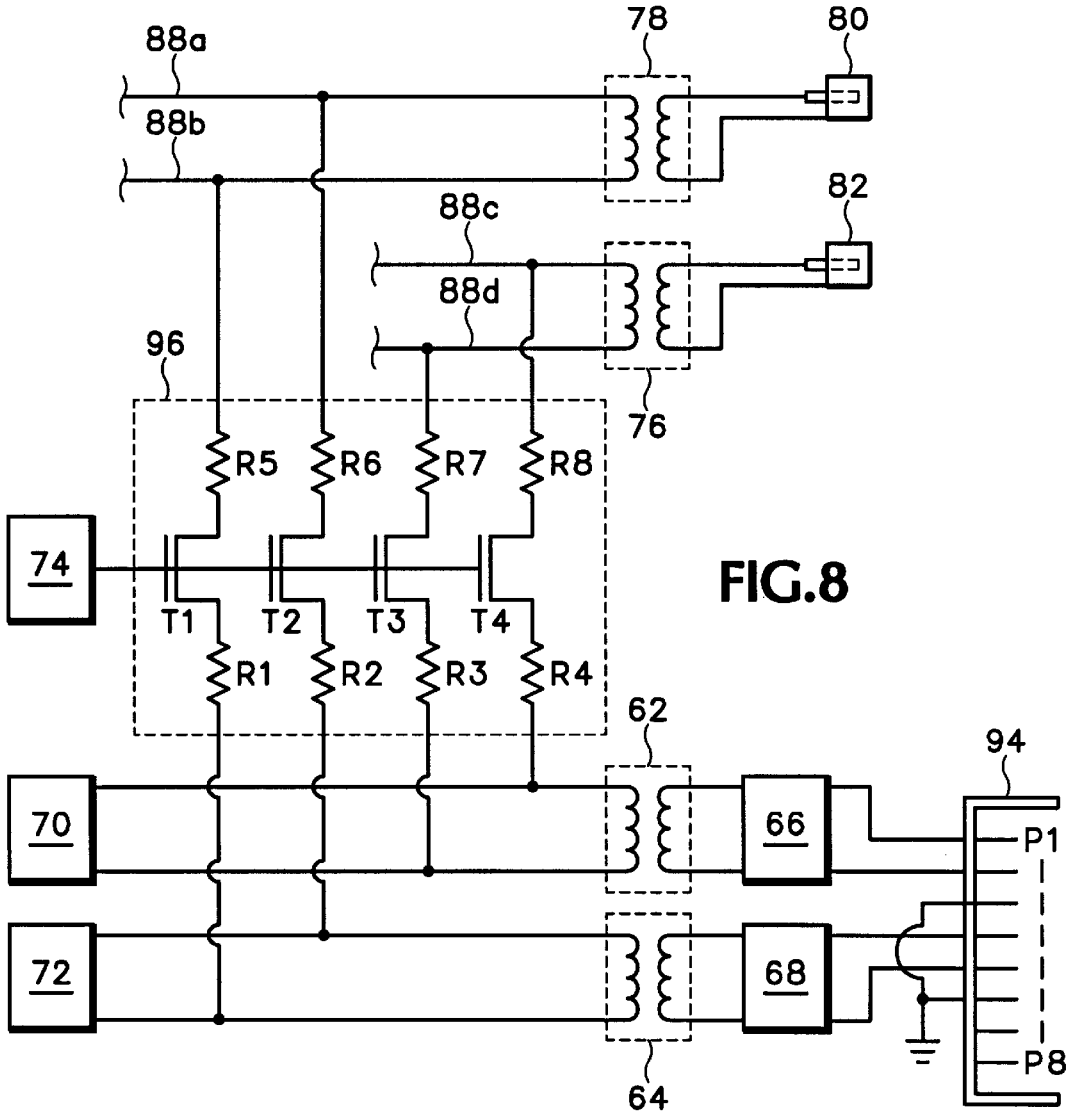
FIG. 8, which illustrates input/output and test circuitry for a single input/output connection of a system according to an embodiment of the present invention.

It is preferred that line isolation transformers 62 and 64, and more particularly the system electronics isolated from data port 94 by transformers 62 and 64, be protected from dangerous or damaging line conditions. It is therefore desirable to include, between port 94 and transformers 62 and 64, line protection circuitry 66 and 68 as shown in FIG. 8. This circuitry should preferably be capable of functioning whether a user connects an unbalanced or a balanced line pair to port 94.

Figure 9:
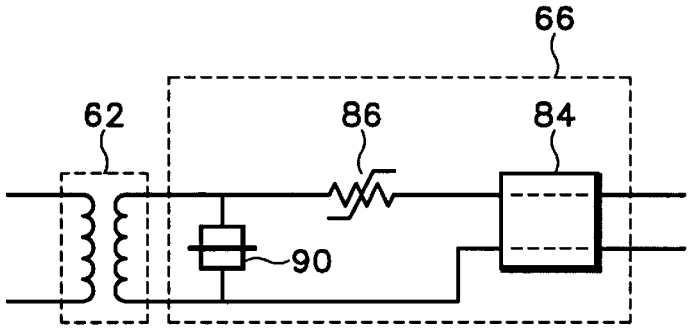
FIG. 9, which depicts input protection circuitry usable with embodiments of the present invention.

FIG. 9 shows a line protection circuit 66 meeting the above requirements. Line protection circuit 66 includes several elements: common mode choke 84, positive temperature coefficient (PTC) resistor 86, and sidactor 90. Choke 84 suppresses EMI. PTC resistor 86 heats up and becomes substantially more resistive if abnormally large current values are present in the incoming line. Sidactor 90 attempts to clamp line voltages that exceed a preset threshold, e.g., 60 V. It is preferred that PTC resistor 86 be inserted in the tip line, rather than the ring line, as the ring line is designed to be shorted to ground in the preferred embodiment to unbalance the transformer.

Figure 12:
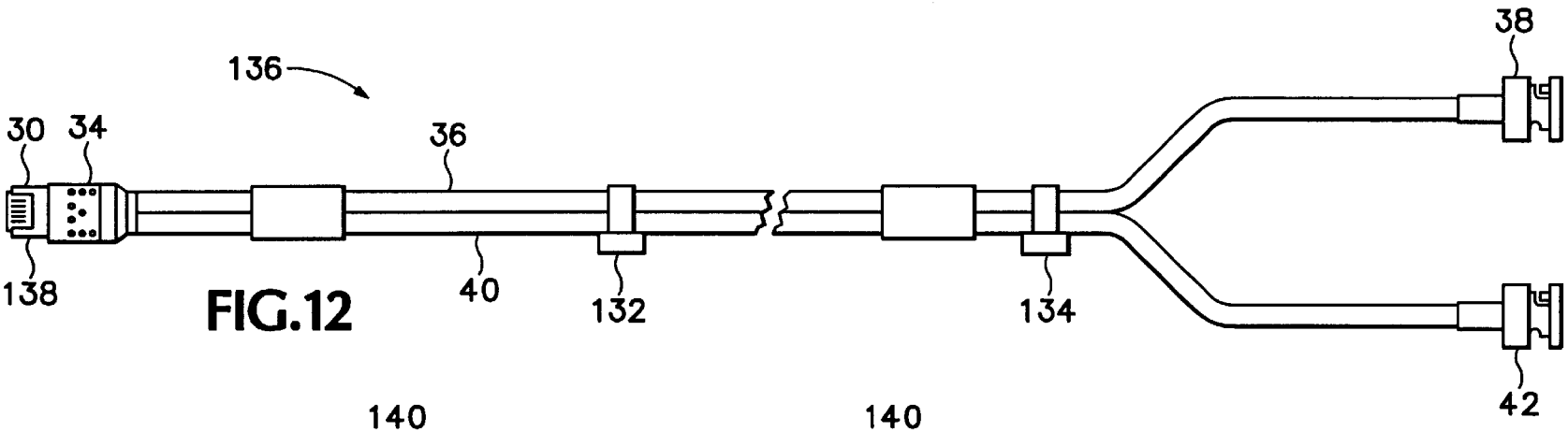
FIG. 12, which illustrates a coaxial to shielded RJ45 patch cable according to an additional embodiment of the present invention.

FIG. 12 illustrates an additional patch cable 136 usable in an embodiment of the present invention. This cable integrates an RJ45 jack 30 with an adapter section 34, such that the remainder of the cable may be constructed of coaxial cables 36, 40. Cables 36, 40 may be of a length required to reach other transmission circuitry connections, such that multiple in-line connections are avoided. Preferably, tie-wraps 132, 134, or similar fasteners, are used to keep cables 36 and 40 joined throughout most of cable 136. An additional advantage of this embodiment is improved impedance matching, since coaxial cables may be run almost right to jack 30.

FIG. 12 further illustrates an RJ45 jack 30 comprising a conducting jack shield 138. In one preferred configuration, the patch cable utilizes shield 138 to unbalance a system's transformers. In such a configuration, the system shield housing that mates with jack shield 138 must supply an appropriate ground connection. The shields of coaxial cables 36 and 40 are each connected to shield 138. They also connect to what would be the "ring" contacts of jack 30 in a balanced connection. This embodiment advantageously reduces the number of jack contacts required to implement an embodiment of the invention.

Figure 13B:
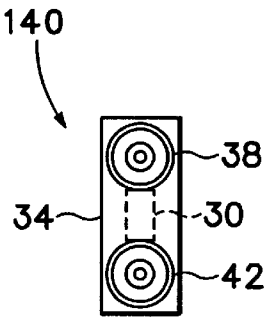
FIGS. 13*a* and 13*b*, which illustrate, respectively, top and front elevations of a coaxial to RJ45 converter according to the present invention.
Figure 13A:
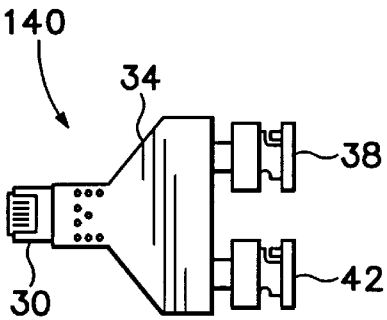

FIGS. 13*a* and 13*b* show two views of a "cable-less" converter 140 according to the present invention. In converter 140, RJ45 jack 30 and BNC connectors 38 and 42 connect directly to adapter section 34. Existing coaxial cables may be connected directly to converter 140. Converter 140 requires no cable sections.

Although the invention as described to this point can provide substantial front panel savings by alleviating the need for separate balanced and unbalanced connectors, test and monitoring connections still require additional panel space. Furthermore, test and monitoring connections should, with the disclosed balanced/unbalanced connection scheme, be able to function equally well with either type of connection. The following aspects of the invention address these issues.

FIG. 8 shows further aspects of an embodiment of the invention, i.e., aspects related to test and monitor connections. This circuitry provides a receive monitor port 80 and a transmit monitor port 82 (e.g. bantam jack connectors), thereby allowing the user to monitor data signals passing through data port 94. The preferred embodiment uses a switch circuit 96 to connect and disconnect monitor ports 80 and 82 from port 94. Controller 74 preferably electronically activates and deactivates switch circuit 96 to enable and disable monitoring on ports 80 and 82.

In the embodiment of FIG. 8, switch circuit 96 comprises four analog switches T1, T2, T3, and T4. These analog switches, when enabled by controller 74, serve to connect port isolation transformers 76 and 78 across data isolation transformers 62 and 64. One preferred embodiment uses field-effect transistors for analog switches T1, T2, T3, and T4. It is preferred that the transistors switch approximately at TTL gate voltage levels (e.g., off for a gate voltage $\leqq 0.6$ V, on for a gate voltage $\geqq 2.0$ V).

Resistors R1 through R8 are included in switch circuit 96 for several purposes. First, these resistors ensure that the impedance of the test circuitry will not adversely affect the impedance match between attached data lines and processing circuitry 70, 72. Second, these resistors help attenuate the signal at the test port, preferably by about 20 dB as compared to the signal present at the data port. Finally, these resistors help prevent line errors during transition of switches T1–T4 between off and on states, by dissipating stored charge on the transistors that may otherwise cause momentary deviations in line voltage. In one embodiment, resistor values were selected as follows: R1, R2, R3, R4, R5, R6—100 ohms each; R7, R8—700 ohms each.

Figure 10:
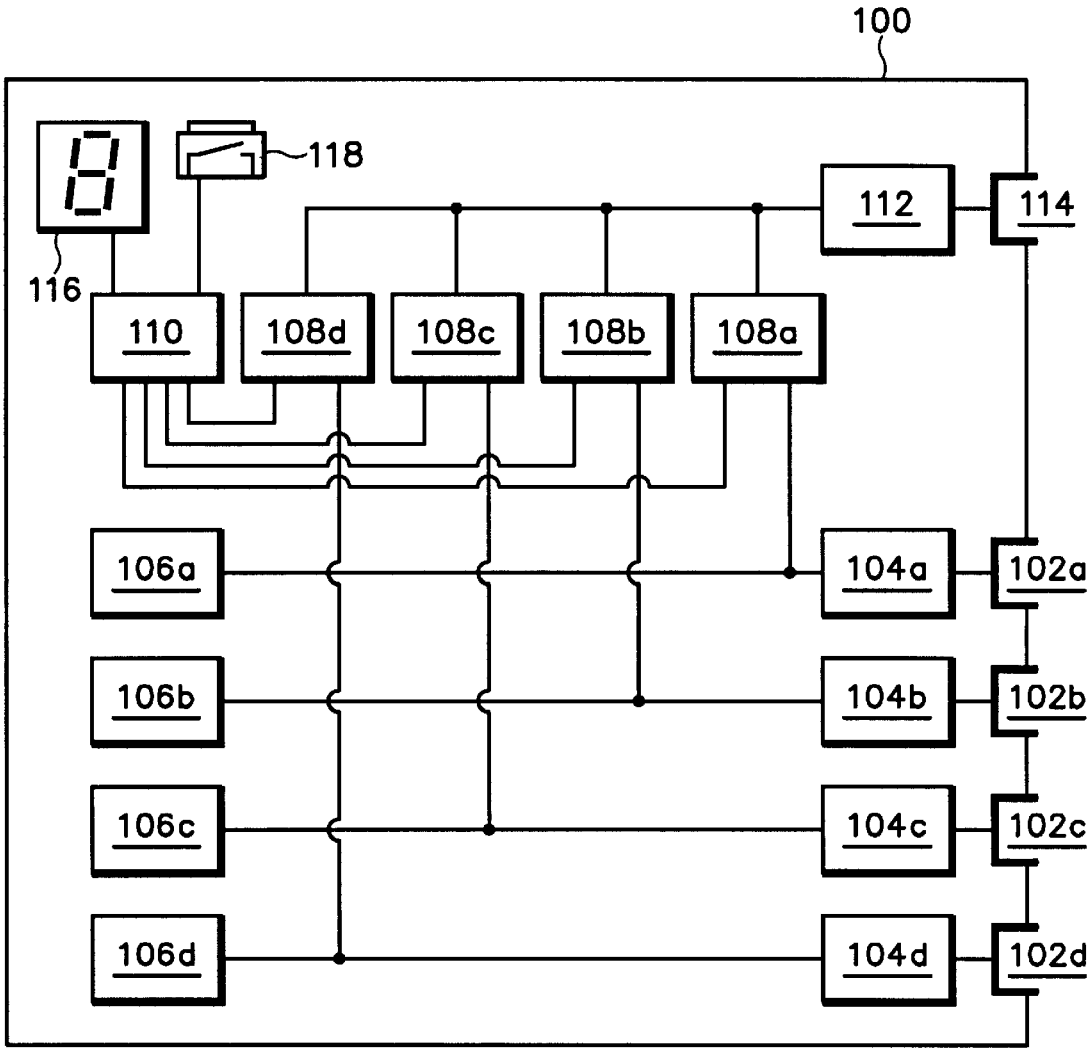
FIG. 10, which contains a block diagram of a system for communicating with multiple data channels having a single switchable test jack.

Circuitry such as that depicted in FIG. 8 advantageously enables multiple data ports to be multiplexed onto a single monitor port. For instance, FIG. 10 shows a block diagram of a digital communication system 100 that may be connected to data lines through four external data ports 102*a*, 102*b*, 102*c*, and 102*d*. Each data port connects through one of isolation transformers 104*a*, 104*b*, 104*c*, and 104*d* to data processing circuitry 106*a*, 106*b*, 106*c*, and 106*d* (which may all be located on a common processor). An external monitor port 114 is also connected to system 100 through its own isolation transformer 112. Any one of the four data signals shown may be connected to monitor port 114 by enabling the appropriate switch circuit—either 108*a*, 108*b*, 108*c*, or 108*d*.

Controller 110 is connected to switch circuits 108*a*, 108*b*, 108*c*, and 108*d*, e.g., in the manner shown for connecting controller 74 to switch circuit 96 in FIG. 8. Controller 110 also accepts input from pushbutton switch 118, and controls display 116. Controller 110 may, for instance, comprise a microprocessor in communication with a field programmable gate array that actually asserts signals to switch circuits 108*a*, 108*b*, 108*c*, and 108*d*.

In operation, controller 110 initially sets all four switch circuits off, such that no signal is present on monitor port 114. Controller 110 also initializes an internal pointer to data channel 0 (data port 102*a*). The current pointer value is always sent to display 116, such that the current selected data channel will be displayed to an operator.

After initialization, controller 110 then periodically polls pushbutton switch 118. If a switch closed condition is detected, controller 114 runs a timer until it detects that switch 118 has been released. If the timer value at switch release is less than a preset value (e.g., two seconds), controller 110 increments its internal pointer value to the next data channel, or back to channel 0 if the pointer value increments past the last valid data channel. If the timer value exceeds the preset value, controller 110 toggles an internal monitor port enable setting.

Toggling of the monitor port enable setting to "on" causes two responses. First, controller 110 uses the current pointer value to determine the appropriate switch circuit (e.g., 108*a* for data channel 0) and then enables this switch circuit. Second, controller 110 signals display 116 to indicate, along with the data channel, that the monitor port is connected. In one embodiment, the display shows a "B", indicating that the bantam jack port is enabled. With the "B" displayed, a quick push of switch 118 causes the controller to send the next data channel to port 114. The controller accomplishes this by turning off the currently enabled switch circuit, incrementing the channel pointer value, and enabling the corresponding switch circuit. Toggling of the monitor port enable setting to "off" removes the "B" from the display and again disables all switch circuits.

It is important that switch circuits 108*a*, 108*b*, 108*c*, and 108*d* present a high impedance when disabled to avoid crosstalk between the data channels that are commonly tied at transformer 112. One incoming data channel may be greatly attenuated. If a second, much stronger channel is switched onto monitor port 114, the switch circuit of the attenuated data channel must have sufficient off-selectivity to prevent the strong channel from overwhelming a weak incoming channel by feedback through the monitor circuitry.

A final important consideration for the switch circuits is their capacitance. Switch capacitance is effectively multiplied by the number of multiplexed channels. Thus, the bandwidth of the signal at the monitor port may be adversely affected in a system with a large number of data channels. Capacitance should therefore be kept at a reasonable value for the bandwidth of the system.

Figure 11:
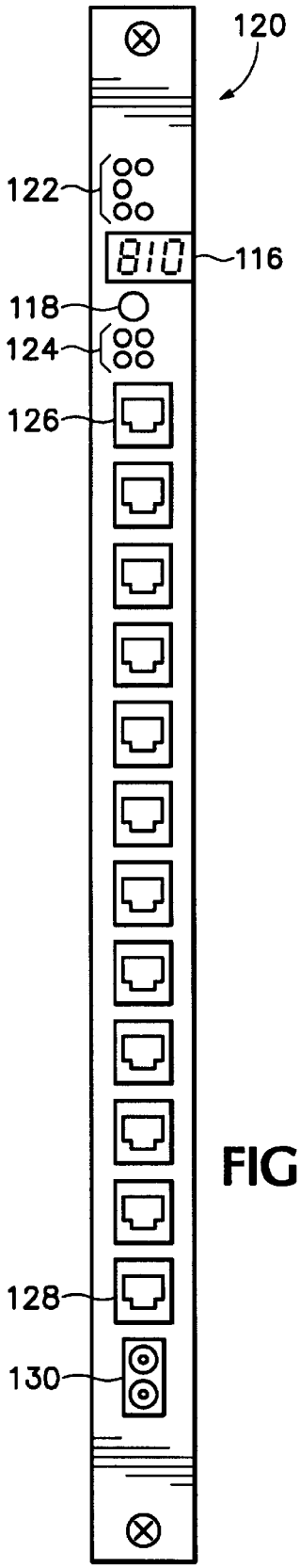
FIG. 11, which shows the front panel configuration for a system embodiment according to the present invention.

FIG. 11 shows the front panel 120 for an access concentrator card capable of connecting to twelve T1 or E1 receive/transmit pairs (RJ45 port 126 for data channel 0, RJ45 port 128 for data channel 11, with the other intermediate ports serving data channels 1–10. A pair of bantam jack ports 130 are also supplied for monitor and test connections. Pushbutton 118 allows a user to select and connect data ports to test port 130, as discussed previously in conjunction with FIG. 10. The currently selected port, along with test port connection status, appears on liquid crystal display 116. For example, the illustrated display value indicates that data channel 10 is connected to the test port. LEDs 122 and 124 display various system status conditions.

In some panel configurations, sufficient space for an LCD display may not exist. Other forms of electronic indication of test port selection may be substituted in such a case. For example, an LED may be mounted in proximity to each external port. The LED corresponding to each port may be wired such that current passes through it when the corresponding switch circuit is enabled. This embodiment relieves the test system controller of the task of controlling a display separate from control of the test circuits.

The monitor switch and control circuitry embodiment described herein has several advantages besides the decreased panel space required by a multiplexed test port. First, low voltage switches and direct electronic controller connections may be used, as the switching circuitry is isolated from the ports. Second, tester circuitry and the operator are protected from overvoltage and other undesirable conditions that may occur on the data lines themselves. Third, channel monitoring is easily controlled and reconfigured. Fourth, the test operator need not be concerned with whether the data lines are configured for balanced or unbalanced operation. Finally, an operator is less likely to disrupt ongoing data communications by monitoring them—the physical test port connection may be established before any data signal is routed to the test port, and the subsequent electronic switching should place no significant noise on the data channel itself.

After reading this disclosure, one of ordinary skill in the electronics art will recognize that many functionally equivalent electronic designs are possible. The exact pin configurations shown are not critical, as long as they are consistent with the general teachings presented herein. Other ports and jacks may be used with the present invention, with more or less contacts and data channels—the embodiments described herein were selected merely because they utilize widely accepted components. Patch cables, although desirable, need not be used if data lines are appropriately wired to a jack so as to cause transformer unbalancing when required.

One of ordinary skill will also recognize that a large arsenal of controller and user interface configurations are at their disposal. Controller choices include a programmable microprocessor, a special-purpose state machine, a programmable logic array, a field-programmable gate array, static or dynamic volatile or non-volatile random access memory, read-only memory, erasable read-only memory, electronically-erasable read-only memory, magnetic or optical storage media, latches, and combinations of these devices. Such controller components may reside entirely on a common board with the data processing circuitry, be distributed among several boards sharing a common bus, or even be communicated through a digital network from a remote system. Likewise, the single pushbutton controller may be replaced by two pushbuttons, multi-position switches, keypads, or other common input devices the single—pushbutton, however, requires less panel space that most alternate input devices.

Although the specific embodiments described herein utilize field effect transistors as analog switches, other electronic devices may serve equally well as analog switches. It is desirable that the switch be capable of functioning over the fill range of expected input signals without introducing distortion, that the switch change state relatively noiselessly, that it present a low serial resistance and low capacitance when on, and high serial resistance and low capacitance when off.

Other modifications to the disclosed embodiments will be obvious to those of ordinary skill in the art upon reading this disclosure, and are intended to fall within the scope of the invention as claimed.

What is claimed is:

1. A patch cable for use with unbalanced signals, said patch cable comprising:

a first connector having at least first and second electrical contact points, said first contact point configured for connection to a shielded signal conductor and said second contact point configured for connection to the shield of the same signal conductor; and a second connector configured for connection to a data port, said second connector having at least first, second, and third electrical contact points, wherein said first contact point of said first connector is electrically connected to said first contact point of said second connector, and wherein said second contact point of said first connector is electrically connected to both the second and third electrical contact points of said second connector.

2. The patch cable of claim 1, further comprising a cable section physically joining said first and second connectors.

3. The patch cable of claim 2, wherein said cable section comprises a coaxial conductor where it joins said first connector and comprises a twisted pair where it joins said second connector.

4. The patch cable of claim 2, wherein said first connector is a coaxial connector.

5. The patch cable of claim 4, wherein a segment of said cable adjoining said first connector is coaxial.

6. The patch cable of claim 2, wherein said second connector is a modular jack connector.

7. The patch cable of claim 6, wherein a segment of said cable adjoining said second connector comprises a shielded twisted pair.

8. The patch cable of claim 2, wherein said first connector is a coaxial connector and said second connector is a modular jack connector.

9. The patch cable of claim 2, wherein said second connector comprises a metallic shell.

10. The patch cable of claim 2, wherein said second and third electrical contact points of said second connector are electrically connected together at a point along said cable relatively near said second connector and relatively distant from said first connector.

11. The patch cable of claim 1, wherein said first connector is a coaxial connector.

12. The patch cable of claim 1, wherein said second connector is a modular jack connector.

13. A patch cable for use with a pair of unbalanced signals, said patch cable comprising:

a first connector having at least first and second electrical contact points, said first contact point configured for connection to a first shielded signal conductor and said second contact point configured for connection to the shield of said first signal conductor;

a second connector having at least first and second electrical contact points, said first contact point configured for connection to a second shielded signal conductor and said second contact point configured for connection to the shield of said second signal conductor; and a third connector having at least first, second, third, fourth, fifth, and sixth electrical contact points, wherein said first contact point of said first connector is electrically connected to said first contact point of said third connector, said second contact point of said first connector is electrically connected to both the second and third electrical contact points of said third connector, said first contact point of said second connector is electrically connected to said fourth contact point of said third connector, and said second contact point of said second connector is electrically connected to both the fifth and sixth electrical contact points of said third connector.

14. The patch cable of claim 13, wherein said first and second connectors are coaxial connectors.

15. The patch cable of claim 14, wherein said third connector is a modular jack connector.

16. The patch cable of claim 15, wherein said modular jack connector has 8 pins.

17. The patch cable of claim 13, wherein said patch cable further comprises:

a first coaxial cable section adjoining said first connector;

a second coaxial cable section adjoining said second connector;

a twisted pair cable section adjoining said third connector; and an adapter section joining said first and second coaxial cable sections with said twisted pair cable section.

18. The patch cable of claim 17, wherein said first and second connectors are coaxial connectors and said third connector is a modular jack connector.

19. The patch cable of claim 13, wherein said third and sixth contact points of said third connector comprise a single, common contact point.

20. The patch cable of claim 19, wherein said single, common contact point also forms a shield on said third connector.

* * * * *

UNITED STATES PATENT AND TRADEMARK OFFICE

CERTIFICATE OF CORRECTION

PATENT NO. : 6,250,936 B1
DATED : June 26, 2001
INVENTOR(S) : Armistead et al.

It is certified that error appears in the above-identified patent and that said Letters Patent is hereby corrected as shown below:

Column 4,
Line 45, "contacts C-C8" should read -- contacts C1-C8 --

Column 8,
Lines 24-25, "devices the single—pushbutton" should read -- devices—the single pushbutton --

Signed and Sealed this

Nineteenth Day of March, 2002

*Attest:*

*Attesting Officer*

JAMES E. ROGAN
*Director of the United States Patent and Trademark Office*